US007057101B2

(12) United States Patent
Ishida

(10) Patent No.: US 7,057,101 B2
(45) Date of Patent: Jun. 6, 2006

(54) ACTION

(75) Inventor: Muneo Ishida, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 342 days.

(21) Appl. No.: 10/774,569

(22) Filed: Feb. 9, 2004

(65) Prior Publication Data

US 2004/0177740 A1 Sep. 16, 2004

(30) Foreign Application Priority Data

Feb. 28, 2003 (JP) ..... 2003-054541

(51) Int. Cl.
*G10C 3/18* (2006.01)

(52) U.S. Cl. ..... 84/236

(58) Field of Classification Search ..... 84/13, 84/18, 24–29, 236–243
See application file for complete search history.

(56) References Cited

U.S. PATENT DOCUMENTS 4,685,371 A * 8/1987 Levinson ..... 84/239
4,854,211 A * 8/1989 Tanaka et al. ..... 84/240
5,986,202 A * 11/1999 Seiler ..... 84/719

FOREIGN PATENT DOCUMENTS

JP 10-20858 1/1989

* cited by examiner

*Primary Examiner*—Kimberly Lockett
(74) *Attorney, Agent, or Firm*—Davis & Bujold, P.L.L.C.

(57) ABSTRACT

An action in an acoustic piano is provided which can reproduce the touch and feel of the key depression generated in a normal performance mode even in a silent performance mode. The acoustic piano is capable of being switched between the normal performance mode and the silent performance mode. In the silent performance mode, a rotation lever of a transmission switching mechanism disconnects the hammer operating portion from the key. A load switching mechanism is rotated to lower the tip of a weight lever to abut directly upon the upper face of the key. Then, the weight lever swings up and down corresponding to the key depression of a player, closely reproducing the touch and feel of a conventional acoustic piano.

15 Claims, 4 Drawing Sheets

ACTION

BACKGROUND OF THE INVENTION i) Technical Field of the Invention

This invention relates to an action of a piano which can be switched between a normal performance mode and a silent performance mode.

ii) Description of the Related Art

A piano has been known that has an electronic sound source and an acoustic sound mechanism so that it can be played in an electronic sound mode as well as in an acoustic sound mode. For example, such a piano comprises switching means for abutting and separating an action, which transmits the key depression to a hammer, onto and away from a key. Generation of a string striking sound can be prohibited by preventing the key depression from being transmitted to the hammer when the piano is in the electronic sound mode (silent performance mode). Therefore, if a player plays this piano in the silent performance mode and listens to the sounds produced by an electronic sound source through headphones, etc., the sounds do not escape to the outside and the player can freely enjoy playing without disturbing the neighborhood, even in a housing complex or an area with houses lined closely together.

Unexamined Japanese Patent Publication No. 10-20858 discloses a keyboard instrument such that when the player depresses the key in the silent performance mode, not only is the action prevented from being abut upon the key, but a dummy load is also applied to the key so as to give a touch and feel for the fingers of the player similar to that obtainable in the normal performance mode.

In this case, the action arranged between the key and the string for swinging the hammer is separated away from the key by means of a wippen lifter, and a reset spring is made to abut resiliently upon the upper face of the key in order to apply the dummy load. When the player depresses the key against the urging force of this reset spring and then releases the key, the key is moved back to its original position due to the spring force of the reset spring. In the silent performance mode, the touch and feel based upon the action mechanism is replaced with the touch and feel based on the reset spring.

According to the aforementioned keyboard instrument, however, the spring force of the reset spring, which is made to abut resiliently on the upper face of the key, is applied to the key in the silent performance mode. Since the spring force is varied depending on the amount of displacement of the key due to the key depression of the player, the touch and feel from the normal performance mode cannot be reproduced with great precision.

It is also feared that the spring may be eventually worn and damaged. The spring force may be gradually lost due to repeated expansion and contraction of the spring caused by the key depression.

SUMMARY OF THE INVENTION

One object of the present invention is to provide an action that allows precise reproduction of a touch and feel close to that obtainable in a normal performance mode, even in a silent performance mode, in an acoustic piano capable of being switched between a normal performance mode and a silent performance mode.

In order to attain the above object, the present invention provides an action of a piano, comprising a hammer operating portion, for swinging a hammer for striking a string, and a transmission switching device, for switching between abutment and separation of the hammer operating portion onto and away from a key. The piano can be switched between a normal performance mode and a silent performance mode. In the normal performance mode, the hammer operating portion is operated to strike the string corresponding to the key depression of a player. In the silent performance mode, the hammer operating portion is not operated. The action further comprises a weight lever provided per key and arranged along a longitudinal direction of the key above the side opposite to the player side, beyond a fulcrum on which the key pivots. One end of the weight lever is engaged rotatably with a rotation shaft. The other end of the weight lever is allowed to swing in a pivotal direction of the key with the rotation shaft as a fulcrum. The weight lever is also allowed to abut upon the upper face of the key and due to its own weight, apply a load acting against the key depression. The action further comprises a weight switching device for switching the load of the weight lever.

According to the above action, the hammer operating portion is separated away from the key in the silent performance mode. As a result, the load of the weight lever is applied to the key and a touch and feel similar to that obtainable in the normal performance mode due to key depression can be reproduced with precision. Furthermore, the weight lever of the present action swings up and down in conjunction with the motion of the key immediately after the player has depressed the key. When the key is fully depressed and the motion of the key is suspended, the weight lever continues to move independently away from the key according to the law of inertia due to its own weight. Since the movement is similar to that of a hammer of a grand piano, a touch and feel can be obtained close to that caused by the key depression in a grand piano. Moreover, in the aforementioned action, the load applied to the key in the silent performance mode is the weight of the weight lever. Therefore, the amount of the load applied to the key does not change even after long periods of repeated key depression, and the touch and feel obtained by the system can remain stable.

The load switching device of the aforementioned action can make the weight lever abut onto the key in order to apply the load of the weight lever to the key, or separate the weight lever away from the key in order to remove the load of the weight lever off of the key.

It is preferable that the load switching device of the aforementioned action changes the abutment position between the key and the free end of the weight lever. Then the load applied by the weight lever to the key can also be changed and the touch and feel at the point of key depression becomes adjustable.

It is preferable that the transmission switching device and the load switching device are connected and cooperate with each other. Then, switching between the silent performance mode and the normal performance mode can be relatively easy.

It is preferable that the weight lever comprises a rotation roller on the free end thereof and abuts onto the upper face of the key through the rotation roller. According to this construction, excessive friction is not generated between the weight lever and the abutment portion of the key because the load of the weight lever is applied to the key only through the rotation roller. Therefore, the key moves smoothly and the touch and feel can be quite favorable.

The abutment position between the weight lever and the key may be freely moved along a longitudinal direction of the key. Then, the distance between the working point of the load applied to the key by the weight lever and the fulcrum on which the key pivots is changed, and the touch and feel during key depression can be adjusted.

It is further preferable that the transmission switching device of the present action comprises a rotation body with essentially an oval cross section which rotates on a rotation shaft located below the hammer operating portion. Then, the transmission switching device can switch between connection and disconnection of the hammer operating portion both with and away from the key. This is done by rotating the rotation body to make the outer circumference of the rotation body abut upon the hammer operating portion and moving the hammer operating portion away from the pivotal element of the key.

BRIEF DESCRIPTION OF THE DRAWINGS

The invention will now be described, by way of example, with reference to the accompanying drawings, in which.

DETAILED DESCRIPTION OF PREFERRED EMBODIMENT

First Embodiment

Figure 1:
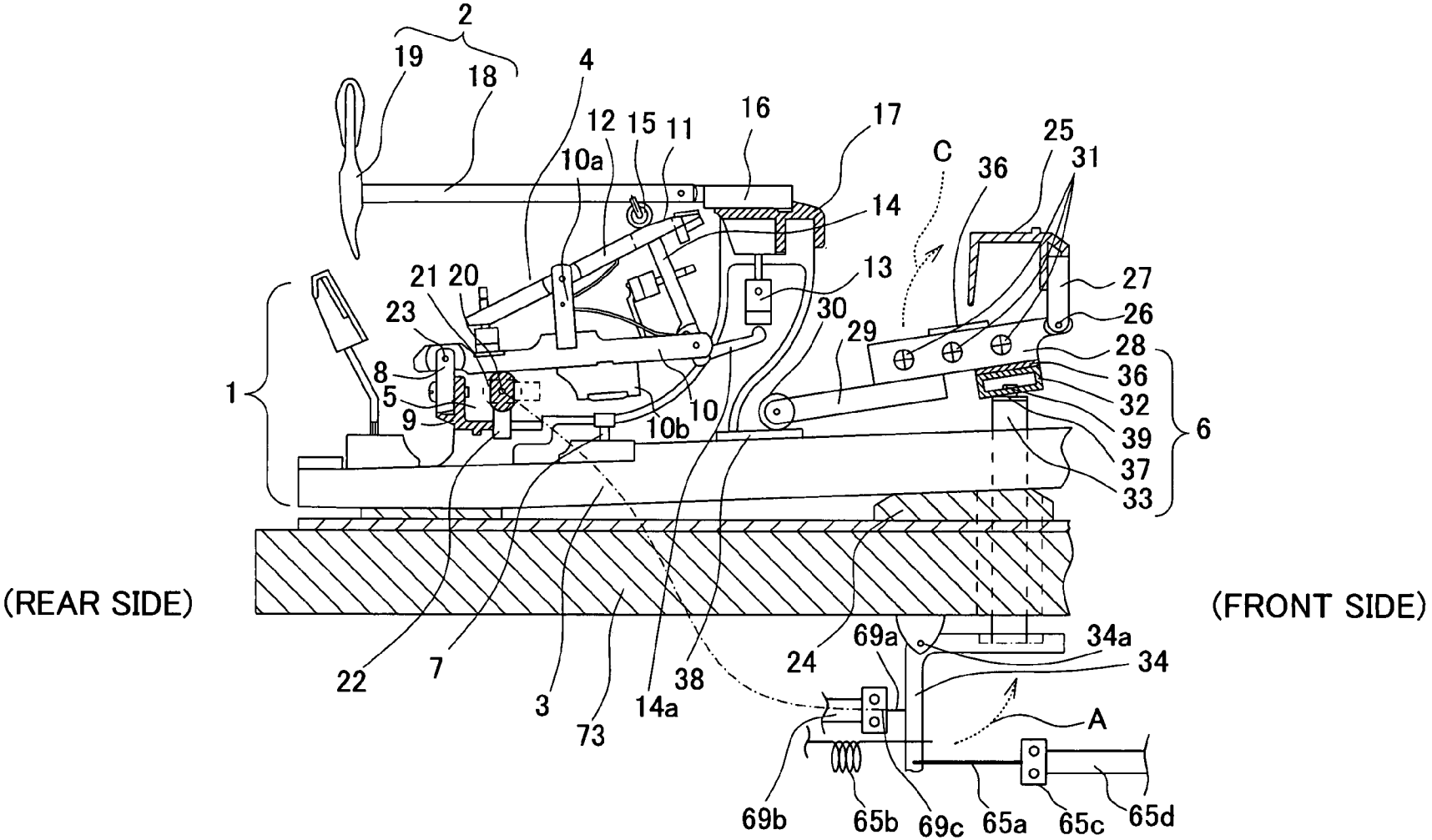
FIG. 1 is a side view showing a construction of an action of a grand piano according to a first embodiment of the present invention.

Referring to FIG. 1, an action 1 comprises a hammer operating portion 4 for swinging a hammer 2 in order to strike a string, a transmission switching mechanism 5 for switching between the connection and disconnection of the hammer operating portion 4 both with and away from a key 3, a weight lever 28 provided per each key and arranged along a longitudinal direction of the key 3 for applying the load of the weight lever 28 to the key 3, and a load switching mechanism 6 for switching abutment and separation of a free end of the weight lever 28 with and from the key 3.

A standard grand piano has a total of 88 keys 3. Each key 3 is arranged to pivot around an intermediate plate 24 acting as a fulcrum. When the front side (player side to the right of FIG. 1) of the key 3 is depressed, the rear side (opposite to the player side and beyond the intermediate plate 24) of the key 3 is raised to transmit the key depression to the hammer operating portion 4.

The hammer operating portion 4 comprises a capstan screw 7, a wippen 10, a repetition lever 12, a jack 14, and a shank roller 15. The capstan screw 7 is raised when the key 3 is depressed. The wippen 10 is supported rotatably by a wippen rail 9 via a wippen range 8 and swings upward as the capstan screw 7 is raised. The rotation shaft of the wippen 10 is shown as reference number 23 in FIG. 1. The repetition lever 12 is provided with a long hole 11 (hereafter, referred to as a "jack guide hole") located on the tip thereof. The repetition lever 12 is supported by a support 10*a* above the wippen 10 so as to be rotated about the tip of the support 10*a* as the wippen 10 swings upward. The jack 14 is connected to the tip of the wippen 10 in a rotatable manner. The upper end portion (hereafter referred to as a "hammer pushup portion") of the jack 14 is fitted within the jack guide hole 11 of the repetition lever 12. The jack 14 is raised with the wippen 10 till a regulating abutment portion 14*a* of the jack 14 abuts upon a regulating button 13. The shank roller 15 abuts upon the upper face of the repetition lever 12. When pushed up with the hammer pushup portion of the jack 14, the shank roller 15 is separated from the upper face of the repetition lever 12. The hammer operating portion 4 serves to swing the hammer 2 to strike a string.

The hammer 2 is comprised of a hammer shank 18 and a hammer head 19 attached to the tip of the hammer shank 18. The hammer shank 18 is supported swingably by a shank rail 17 via a shank range 16 and swings upward when the shank roller 15 is pushed up.

The transmission switching mechanism 5 comprises a rotation body 21 arranged below the wippen 10 of the hammer operating portion 4. The rotation body 21 has essentially a cam lobe, preferably oval cross section which rotates on a rotation shaft 20. The rotation body 21 extends in the arrangement direction of the keys 3, perpendicular to the longitudinal direction of the keys 3.

Figure 3:
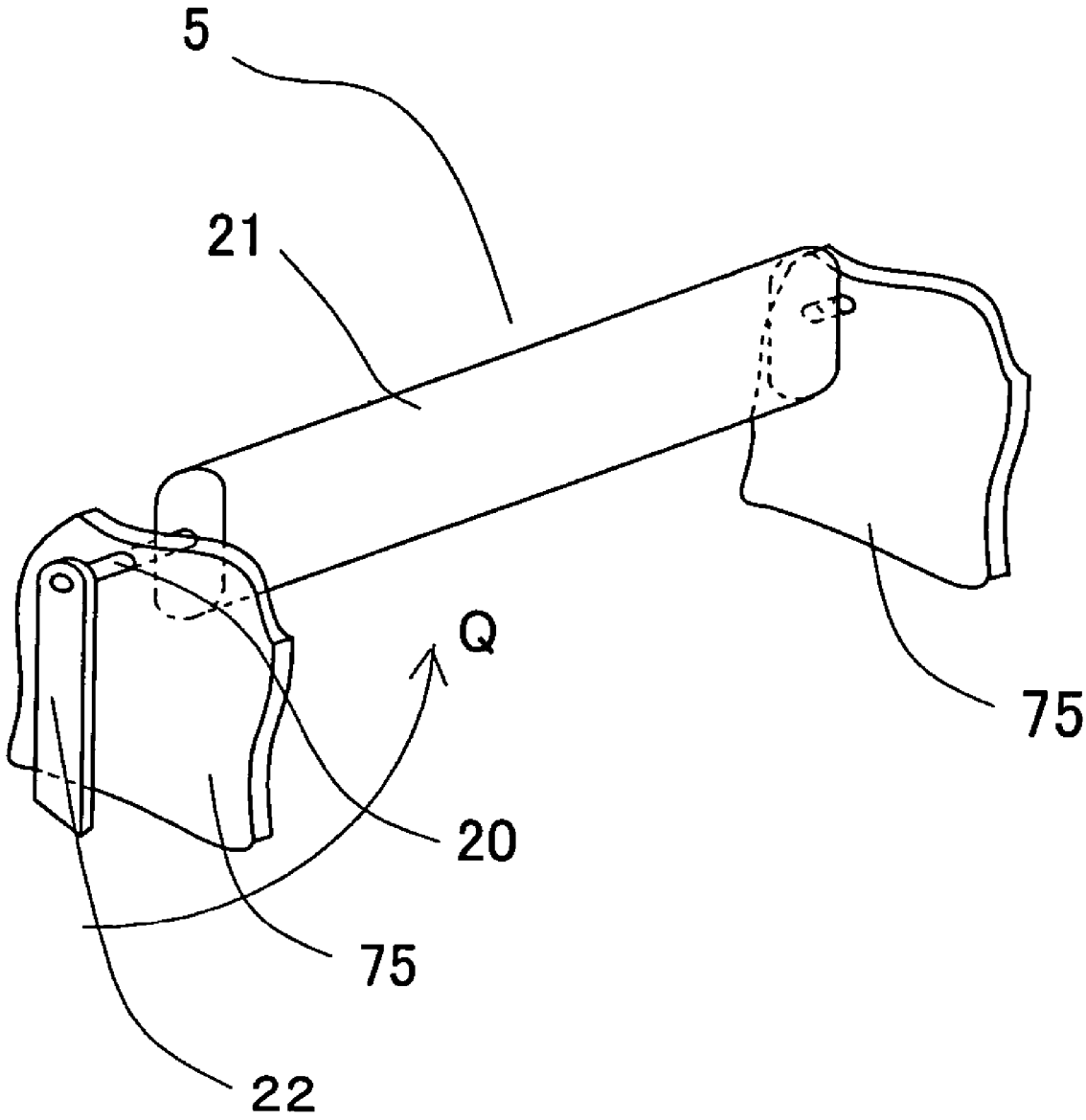
FIG. 3 is a perspective view showing a construction of a transmission switching mechanism according to the first embodiment.

As shown in FIG. 3, the rotation shaft 20 of the rotation body 21 penetrates a side board 75 of a grand piano and a rotation lever 22 is attached to an end of this rotation shaft 20. The tip of the rotation lever 22 is connected to an end of a control wire 69*a*. The control wire 69*a* is passed through a tube 69*b* fixed to the side board 75 of the grand piano via a fixing member 69*c*. The other end of the control wire 69*a* is connected to an L-shaped fitting 34, as shown in FIG. 1. If the L-shaped fitting 34 is rotated counterclockwise in a direction of A shown in FIG. 1, the rotation lever 22 is rotated counterclockwise in a direction of Q as shown in FIG. 3. If the L-shaped fitting 34 is rotated the opposite direction of A (clockwise), the rotation lever 22 is also rotated in the opposite direction of Q (clockwise).

As can be seen in FIG. 1, when the rotation lever 22 is rotated to a substantially vertical position, the oval top of the rotation body 21 abuts upon a wippen heel 10*b*, provided at the bottom of the wippen 10 of the hammer operating portion 4, and pushes the wippen 10 upward (i.e. the entire hammer operating portion 4 is pushed up). Then, the wippen 10 of the hammer operating portion 4 and the capstan screw 7 are separated, resulting in the disconnection of the hammer operating portion 4 from the key 3.

When the rotation lever 22 is rotated to a substantially horizontal position, the wippen 10 swings downward (i.e. the hammer operating portion 4 drops down). Then, the oval top of the rotation body 21 is separated away from the wippen heel 10*b* located at the bottom of the wippen 10 of the hammer operating portion 4, and the hammer 2 is made to strike the string via the hammer operating portion 4 when the key 3 is depressed.

One end of the weight lever 28 is engaged with a flange 27 via the rotation shaft 26. The flange 27 is connected to a stopper rail 25 which is fixed on a piano body and located above the intermediate plate 24. The other end of the weight lever 28 swings in conjunction with the motion of the key 3. An extension rod 29 extending toward the rear side is fixed below the free end of the weight lever 28. A rotation roller 30 is attached to the tip of the extension rod 29. On the side faces of the weight lever 28, lead plummets 31 for the adjustment of the weight of the weight lever 28 are filled in. Felt 38 for reducing a contact sound between the rotation roller 30 and the key 3 is arranged on the upper face of the key 3 having a contact with the rotation roller 30.

The load switching mechanism 6 is comprised of a hollow, longitudinal lifting rail 32, a pushup stick 33 and the L-shaped fitting 34. The lifting rail 32 is arranged under the weight levers 28 and lifts up a plurality of weight levers 28. The pushup stick 33 moves the lifting rail 32 up and down. The L-shaped fitting 34 supports the pushup stick 33 on one end. The corner of the L-shaped fitting 34 is engaged with the rotation shaft 34*a* for rotation.

The other end of the L-shaped fitting 34 is connected with a coil spring 65*b* and a wire 65*a*. The coil spring 65*b* urges the L-shaped fitting 34 towards the rear side of the piano. The wire 65*a* pulls the L-shaped fitting 34 towards the front side of the piano against an urging force of the coil spring 65*b*. One end of the wire 65*a* is passed through a tube 65*d* fixed on the side board of the grand piano via a fixing member 65*c*. The wire 65*a* is operated by a not shown operation lever provided on the other end of the tube 65*d* and is arranged and constructed to pull the wire for a predetermined distance.

Figure 2:
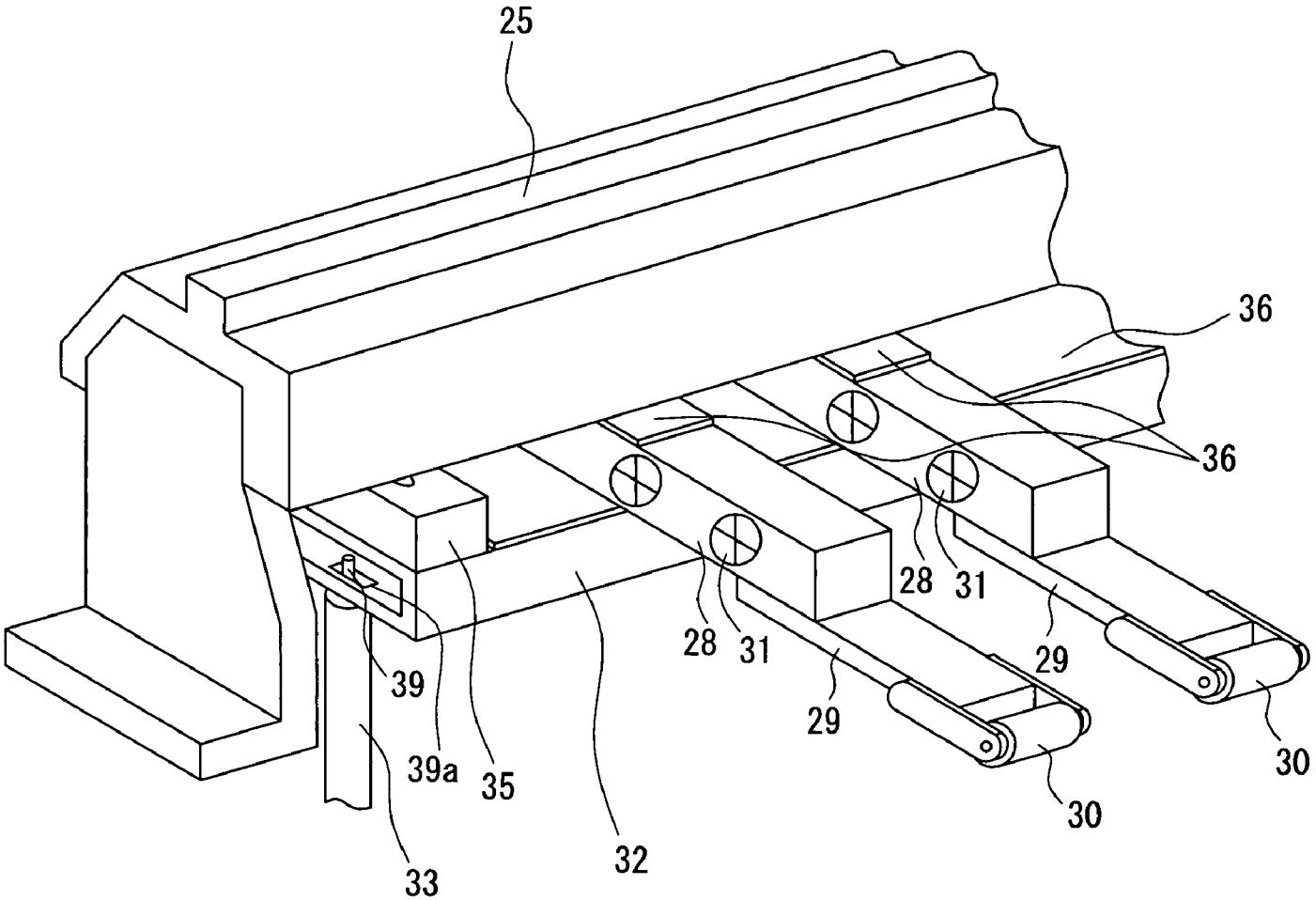
FIG. 2 is a perspective view showing the detail around a weight lever according to the first embodiment.

As shown in FIG. 2, the lifting rail 32 is fixed to lifting levers 35 provided on both ends and at several intermediate portions along an arrangement direction of the keys 3. Each of the lifting levers 35 is fixed swingably to the stopper rail 25 via the flange 27 in substantially the same manner as the weight lever 28. Felt 36 is provided on the upper face of the lifting rail 32 so as to absorb the shock caused when the lifting rail 32 contacts the weight lever 28. Below the lifting rail 32, the pushup stick 33 extends downward and penetrates a key bed 73.

A rubber cap 37 is attached on the upper end of the pushup stick 33 so as to absorb the shock caused when the pushup stick 33 contacts the lifting rail 32. In the upper center portion of the pushup stick 33, a metal pin 39 is provided in a projecting manner. A guide hole 39*a* for the pin 39 is provided on the lifting rail 32.

In the load switching mechanism 6, when the aforementioned not shown operation lever is pulled to the front of the piano, the wire 65*a* is pulled and the L-shaped fitting 34 is rotated counterclockwise to the front side (in the direction of arrow A). Additionally, the pushup stick 33 is pushed upward causing the lifting rail 32 to be moved upward to raise the weight levers 28. The result is that the rotation roller 30 provided on the free end of the weight lever 28 no longer abuts on the felt 38 on top of the key 3. On the other hand, when the not shown operation lever is moved back to the rear of the piano, the L-shaped fitting 34 is rotated clockwise (in the opposite direction of A) due to the urging force of the coil spring 65*b*. The pushup stick 33 is lowered. The lifting rail 32 is moved downward to lower the weight levers 28. The result is that the rotation roller 30 abuts on top of the key 3, through the felt 38, to apply the load of the weight lever 28 to the key 3.

As mentioned previously, the rotation lever 22 of the transmission switching mechanism 5 is connected to the L-shaped fitting 34 via the control wire 69*a* in the action 1 of the present embodiment. Therefore, when the wire 65*a* is pulled and the L-shaped fitting 34 is rotated counterclockwise to the front of the piano (in the direction of A), the rotation lever 22 is also rotated counterclockwise in he direction of arrow Q. To the contrary, when the L-shaped fitting 34 is rotated clockwise (in the opposite direction of A), the rotation lever 22 is rotated clockwise in the direction opposite of arrow Q. In short, the transmission switching mechanism 5 and the load switching mechanism 6 cooperate with each other in the action 1. If the aforementioned not shown operation lever is pulled to the front of the piano, the rotation roller 30 is separated away from the key 3 in the load switching mechanism 6 and the hammer 2 can be operated by the key 3 in the transmission switching mechanism 5. To the contrary, if the not shown operation lever is moved back to the rear of the piano, the rotation roller 30 abuts on top of the key 3 in the load switching mechanism 6 and the hammer 2 cannot be operated by the key 3 in the transmission switching mechanism 5.

Operation of the aforementioned action 1 in the normal performance mode and in the silent performance mode is explained below.

In the normal performance mode, the rotation lever 22 is rotated to a horizontal position (position shown as a dotted line in FIG. 1) so that the outer circumference of the rotation body 21 is separated away from the wippen 10. Then, the wippen 10 abuts on top of the capstan screw 7 and the hammer operating portion 4 is connected to the key 3 corresponding to a key depression of the player.

Furthermore, the L-shaped fitting 34 is rotated in the direction of A to push up the pushup stick 33, lifting rail 32, and weight lever 28. The rotation roller 30 provided on the tip of the weight lever 28 is separated away from the key 3.

As a result, the load of the weight lever 28 is removed from the key 3 and the hammer 2 can be operated by the key 3. When the player depresses key 3, the key depression is transmitted to the hammer operating portion 4 via the capstan screw 7, and the hammer 2 strikes the string.

In the silent performance mode, the rotation lever 22 is rotated to a vertical position (the position shown in a solid line in FIG. 1) to push up the wippen 10. Then, the wippen 10 is separated from the capstan screw 7 and the hammer operating portion 4 is not operated by the key 3.

Furthermore, the L-shaped fitting 34 is rotated in the opposite direction of A to lower the pushup stick 33, lifting rail 32 and weight lever 28. The rotation roller 30 provided on the tip of the weight lever 28 is made to abut upon the key 3.

As a result, the load of the weight lever 28, having a rotation shaft 26 acting as a fulcrum, is applied to the key 3 and the hammer 2 is not operated by the key 3. Immediately after the player has depressed the key 3, the weight lever 28 swings up and down in conjunction with the motion of the key 3. When the key 3 is fully depressed and the motion of the key 3 stops, the weight lever 28 may continue to move independently away from the key 3 according to the law of inertia. As a result, the weight lever 28 swings in a direction of arrow C about the rotation shaft 26 until the weight lever 28 hits the stopper rail 25. After the weight lever 28 hits the stopper rail 25, the weight lever 28, due to gravity, swings in the opposite direction of C about the rotation shaft 26 until the rotation roller 30 abuts upon the key 3.

According to the present embodiment, the action 1 comprises an individual weight lever 28 provided per key and arranged along the longitudinal direction of the key. The weight lever 28 is located above the rear side of key 3 beyond the fulcrum on which the key pivots. One end of the weight lever 28 is engaged rotatably with the rotation shaft 26. The other end of the weight lever 28, having the rotation shaft 26 acting as a fulcrum, abuts upon the upper face of the key 3 due to weight lever 28*s* own weight in order to apply a load to the key 3 and in order to swing corresponding to the key depression of the player. The action 1 further comprises the weight switching mechanism 6 for switching between abutment and separation of the weight lever 28 onto and away from the key 3. Therefore, in the silent performance mode, the weight lever 28 swings according to the key depression of the player to produce a touch and feel close to the touch and feel obtainable in the normal performance mode.

According to the action 1 in the first embodiment, the weight lever 28 swings up and down in conjunction with the motion of the key 3 immediately after the player has depressed the key 3 in the silent performance mode. When the key 3 is fully depressed and the motion of the key 3 stops, the weight lever 28 may continue to move according to the law of inertia, independently away from the key 3. Since the movement of the weight lever 28 is similar to the movement of the hammer 2 of a grand piano, a touch and feel is obtainable close to the touch and feel given when the key is depressed in the grand piano.

According to the action 1 in the first embodiment, the load to be applied to the key 3 is the weight of the weight lever 28. Therefore, even after the key depression is repeated over a long period of time, the load applied to key 3 is not reduced and the touch and feel can remain stable.

Furthermore, in the action of the first embodiment, the rotation lever 22 and the L-shaped fitting 34 are connected via the control wire 69*a*. The transmission switching mechanism 5 and the load switching mechanism 6 can be operated simultaneously. Therefore, switching between the normal performance mode and the silent performance mode is relatively easy.

Moreover, in the action of the first embodiment the free end of the weight lever 28 is provided with a rotation roller 30 via the extension rod 29. The load of a weight lever 28 is applied to the upper face of the key 3 through the rotation roller 30 in the silent performance mode. Therefore, no substantial amount of friction is generated even when the rotation roller 30 abuts upon the key 3. Since the key 3 moves smoothly upon the key depression of the player, the touch and feel can be considered favorable.

SECOND EMBODIMENT

Figure 4:
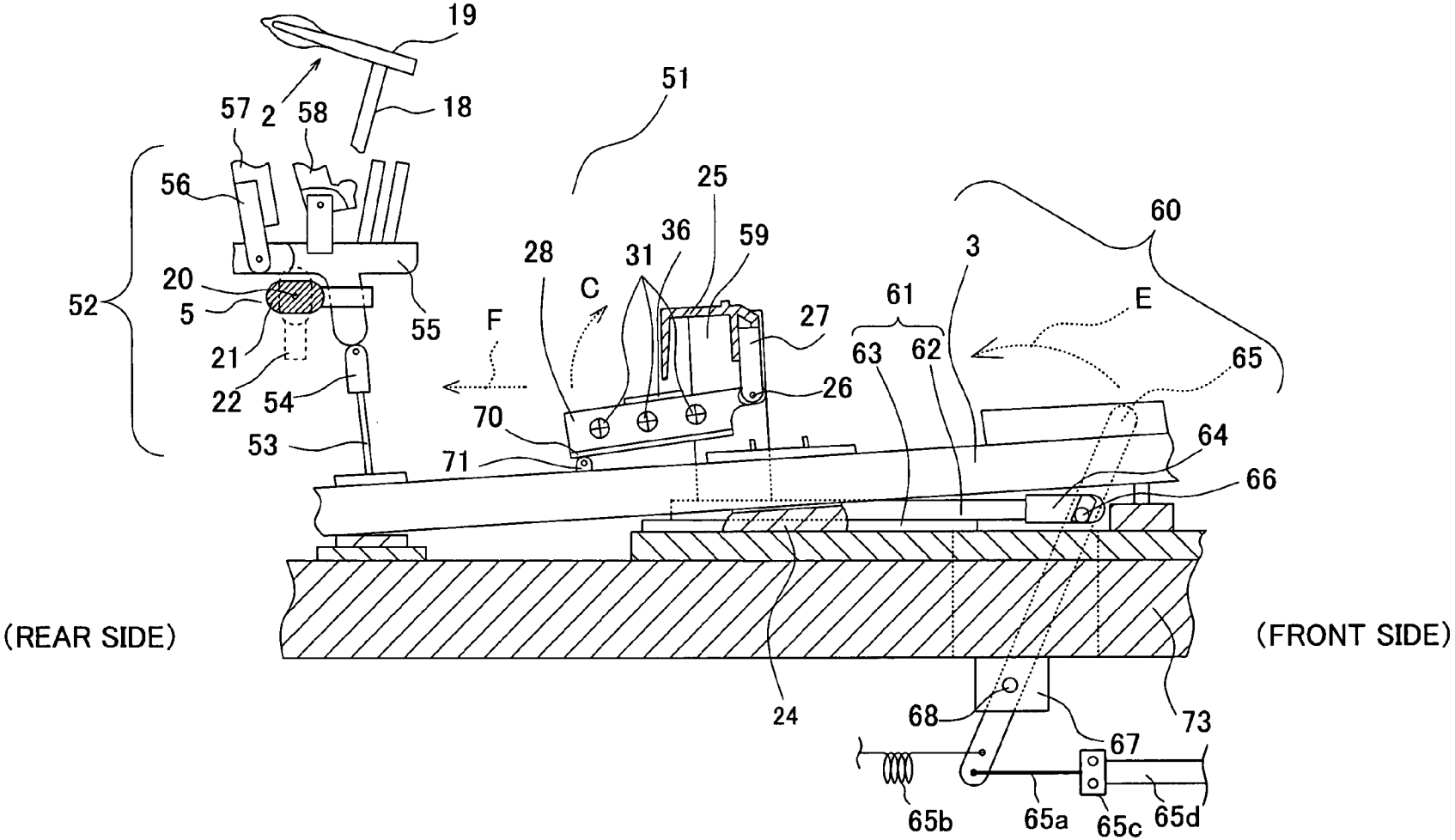
FIG. 4 is a side view of a construction of an action of an upright piano according to a second embodiment of the present invention.

Now, a second embodiment of the present invention is described by way of FIG. 4.

FIG. 4 is a side view of a construction of an action 51 of an upright piano according to the second embodiment of the present invention.

The action 51 comprises a hammer operating portion 52 (only a part of the hammer operating portion 52 is shown in the figure) for swinging the hammer 2 for hitting the string corresponding to the depression of the key 3, the transmission switching mechanism 5 for switching between connection and disconnection of the hammer operating portion 52 with and away from the key 3, the weight lever 28 provided per key 3 and arranged along the longitudinal direction of the key 3 for applying a load to the key 3, and a move mechanism 60 for moving the weight lever 28 along the longitudinal direction of the key 3.

A standard upright piano comprises a total of 88 keys 3. Each key 3 is disposed to swing about the intermediate plate 24 acting as a fulcrum. When the front side (the player side) of the key 3 is depressed, the rear side (opposite to the player side and beyond the intermediate plate 24) of the key 3 is raised to transmit the key depression to the hammer operating portion 52.

The hammer operating portion 52 is comprised of a capstan wire 53 and a capstan button 54, both raised when the key 3 is depressed; a wippen 55 supported rotatably by a center rail 57 via a center rail flange 56 for swinging upward as the capstan wire 53 and the capstan button 54 are raised; and a jack 58 for swinging the hammer 2 as the wippen 55 is raised. When the key depression of the player is transmitted to the hammer operating portion 52 via the capstan wire 53 and the capstan button 54, the hammer operating portion 52 swings the hammer 2 to strike against the string.

As shown in FIG. 3, the rotation shaft 20 of the rotation body 21 in the transmission switching mechanism 5 penetrates the side board 75 of an upright piano. The rotation lever 22 is attached to an end of this rotation shaft 20. The rotation lever 22 outside of the side board 75 of the upright piano is designed to be rotated counterclockwise in the direction of Q or clockwise in the opposite direction.

As can be seen in FIG. 4, when the rotation lever 22 is rotated to a substantially vertical position, the oval top of the rotation body 21 abuts upon the bottom of the wippen 55 of the hammer operating portion 52 and pushes the wippen 55 upward (i.e. the hammer operating portion 55 is raised). Then, the wippen 55 and the capstan button 54 are separated, disconnecting the hammer operating portion 52 from the key 3.

When the rotation lever 22 is rotated to a substantially horizontal position, the wippen 55 swings downward (i.e. the hammer operating portion 52 is also lowered). Then, the oval top of the rotation body 21 is separated away from the bottom of the wippen 55 allowing the hammer operating portion 52 to connect with the key 3.

One end of the weight lever 28 is engaged with a flange 27 via the rotation shaft 26. The flange 27 is fixed to a stopper rail 25 which is located above the intermediate plate 24. The stopper rail 25 is supported by board-like rail supporting members 59, provided on both ends of the stopper rail 25 and at several intermediate positions as well. The other end of the weight lever 28 swings in conjunction with the motion of the key 3.

The weight lever 28 of the action 1 in the first embodiment has a rotation roller 30 on the free end. However, the weight lever 28 in the present embodiment is provided with felt 70 instead of the rotation roller 30, located at the bottom of the weight lever 28 for easing potential sounds of abutment with the key 3. The felt 70 may be replaced with cloth, rubber, or other sound absorbing material. The weight lever 28 is designed to abut upon a lever receiving screw 71 provided on top of the upper face of the key 3 and arranged directly below the weight lever 28. The weight lever 28 can be moved to the direction of F or to the opposite direction in a state that the bottom face of the weight lever 28 is constantly abutted upon the lever receiving screw 71. The contact portion of this lever receiving screw 71 has a rounded form.

The move mechanism 60 is comprised of a slide rail 61 and an arm 65. The slide rail 61 is engaged with the rail supporting member 59 and moves the weight lever 28 along a longitudinal direction of the key 3. The arm 65 is engaged with an upper rail of the slide rail 61 via an arm pin 66 and rotates counterclockwise about an attachment shaft 68 in a direction of arrow E and also rotates clockwise in the opposite direction.

The slide rail 61 is disposed substantially parallel with the keys 3 on the key bed 73 below the supporting member 59. The slide rail 61 is comprised of the upper rail 62 and a lower rail 63. The lower rail 63 is fixed to the piano body. A bearing (not shown) is provided between the upper rail 62 and the lower rail 63 for reducing friction therebetween. The upper rail 62 is designed to slide freely upon the lower rail 63 along the longitudinal direction of the key 3. The rail supporting member 59, fixed to the upper rail 62, is also moved along the longitudinal direction of the key 3 with the sliding of the upper rail 62. With the movement of rail supporting member 59, the stopper rail 25, the flange 27 attached to the stopper rail 25, and the weight lever 28, are all moved. A flange 64 is provided on the front side end of the upper rail 62 of the outermost slide rails 61 among a plurality of slide rails 61 provided per each key 3. The arm pin 66, provided on the flange 64, allows the arm 65 and the upper rail 61 to work together with each other.

The arm 65 is only attached to the upper rail 62 of the outermost slide rails 61 from among the plurality of slide rails 61. This requires that there are two arms 65, and one end each of the two arms 65 is attached to an attachment portion 67, provided at the bottom of the key bed 73, so as to be rotated about the attachment shaft 68. Thus, the two arms 65 work together via the attachment shaft 68.

A coil spring 65*b*, for urging the arm 65 to the rear side of the piano, and a wire 65*a*, for pulling the arm 65 to the front side of the piano against the urging force of the coil spring 65*b*, are connected to the lower end (as seen in FIG. 4) of the arm 65. One end of the wire 65*a* is passed through a tube 65*d* fixed to the side board (not shown) of the upright piano via a fixing member 65*c*. The wire 65*a* is operated by means of a not shown operation lever provided at the other end of the tube 65*d* and can be pulled to a predetermined distance.

When the operation lever (not shown) is operated to pull the wire 65*a*, the arm 65 is rotated counterclockwise in the direction of arrow E to slide the upper rail 62 towards the rear of the piano (in the direction of arrow F). Along with the slide, the rail supporting member 59, stopper rail 25, flange 27, and weight lever 28, are moved to the rear of the piano. When the operation lever is moved back to its former position, the arm 65 is rotated clockwise in the opposite direction of E due to the urging force of the coil spring 65*b*, causing the upper rail 62 to slide to the front of the piano. Along with the slide, the rail supporting member 59, stopper rail 25, flange 27, and weight lever 28, are all moved to the front of the piano (in the opposite direction of F).

Operation of the aforementioned action 51 in the normal performance mode and in the silent performance mode is explained below.

In the normal performance mode, the rotation lever 22 is rotated to a horizontal position (the position shown by a solid line in FIG. 4) resulting in the outer circumference of the rotation body 21 being separated from the bottom of the wippen 55. Then, the wippen 55 abuts upon the capstan button 54 and the hammer operating portion 52 is connected with the key 3 and moves corresponding to the key depression of the player.

Then, the arm 65 is rotated clockwise in the opposite direction of E to move the weight lever 28 in the opposite direction of F.

As a result, the weight lever 28 moves closer to the intermediate plate 24 supporting the key 3. The load applied to the key 3 by the weight lever 28 is reduced and the extent of vertical swing of the weight lever 28 is narrowed. Since the hammer operating portion 52 has been returned to a normal performance position, when the player presses the key 3, the key depression is transmitted to the hammer operating portion 52 via the capstan wire 53 and capstan button 54. The result is that the hammer 2 strikes the string.

In the silent performance mode, the rotation lever 22 is rotated to a vertical position (position shown by a dotted line in FIG. 4) to push up the wippen 55. The wippen 55 is then separated from the capstan button 54 and the hammer operating portion 52 is disconnected from the key 3. As a result, the hammer operating portion 52 assumes a silent performance position.

Then, the arm 65 is rotated counterclockwise in the direction of E to move the weight lever 28 in the direction of F.

As a result of the arm 65 rotation, the weight lever 28 moves away from the intermediate plate 24 supporting the key 3 in the direction of F. The load to be applied to the key 3 by the weight lever 28 is increased. The weight lever 28 swings up and down corresponding to the key depression of the player. When the key 3 is fully depressed and the motion of the key 3 is stopped, the weight lever 28 may continue to move, according to the law of inertia, independently away from the key 3. The weight lever 28 may continue to rotate in the direction of C about the rotation shaft 26 till the weight lever 28 hits the stopper rail 25. When the weight lever 28 hits the stopper rail 25, the weight lever 28 reverses rotation and rotates in the opposite direction of C. The weight lever 28 rotates due to gravity about the rotation shaft 26 until the free end thereof comes in contact with the screw 71 located on top of the upper face of the key 3.

According to the action 51 of the present embodiment, the abutment position between the key 3 and the free end of the weight lever 28 can be altered by rotating the arm 65 of the move switching mechanism 60 as described above. The load applied to the key 3 and the swinging range of the weight lever 28 can be adjusted incrementally. Thus, realization of the touch and feel similar to the touch and feel given when playing a grand piano is possible.

In the above, embodiments of the present invention have been described. However, the present invention is not limited to the above embodiments, and other modifications and variations may be possible.

For instance, in the first embodiment, if the extension rod 29 provided on the lower surface of the weight lever 28 is designed to have an adjustable length, the load of the weight lever 28 applied to the key 3 can be freely adjusted.

Also, in the first and second embodiments, the end of the weight lever 28 which is engaged with the rotation shaft 26 is arranged on the player side (the right or front side in FIGS. 1 and 4), and the other free end is arranged on the opposite side of the piano (the left or rear side in FIGS. 1 and 4). However, this arrangement may be reversed so that the free end is arranged on the player side and the end engaged with the rotation shaft 26 is arranged on the opposite side.

Furthermore, the weight lever 28 in the second embodiment may have a rotation roller 30 on the free end in the same manner as the weight lever 28 in the first embodiment.

Conversely, the weight lever 28 in the first embodiment may be provided with felt 70 instead of the rotation roller 30, so that the free end side of the weight lever 28 abuts upon the upper face of the key 3 via the felt 70.

In the first embodiment, the rotation lever 22 and the L-shaped fitting 34 are connected via the control wire 69*a* to make the transmission switching mechanism 5 and the load switching mechanism operate simultaneously. However, the control wire 69*a* may be removed so that the transmission switching mechanism 5 and the load switching mechanism 6 operate independently from each other.

What is claimed is:

1. An action of a piano capable of being switched between a normal performance mode and a silent performance mode, the action comprising:

a hammer operating portion for swinging a hammer to strike a string upon key depression; and a transmission switching device for switching hammer operating portion between normal performance mode and silent performance mode, wherein the hammer operating portion being operated to strike the string in the normal performance mode upon key depression, and the hammer operating portion not being operated in the silent performance mode upon key depression, and a load switching device for providing weighted load for keys, comprising a weight lever comprising a first end and a second end; wherein one of the first and second ends is pivotably connected above the key, wherein the other of the first and second ends is arranged and constructed to abut upon a top surface of the key, said weight lever contacts the top surface of the key upon selection of silent performance mode, wherein said weight lever is capable of inertial motion independently of the key to duplicate hammer throw, effect of said weight lever to the key is reduced during normal performance mode.

2. The action according to claim 1, wherein said transmission switching device and load switching device operate together.

3. The action according to claim 1, wherein said transmission switching device comprises, a rotation body with a cross section comprising a cam lobe, wherein said cam lobe operating to remove the hammer operating portion away from a physical interface with the key.

4. An action of a piano capable of being switched between a normal performance mode and a silent performance mode, the action comprising:

a hammer operating portion for swinging a hammer to strike a string upon key depression; and a transmission switching device for switching hammer operating portion between normal performance mode and silent performance mode, wherein the hammer operating portion being operated to strike the string in the normal performance mode upon key depression, and the hammer operating portion not being operated in the silent performance mode upon key depression, and a load switching device for providing weighted load for keys, comprising a weight lever comprising a first end and a second end; wherein one of the first and second ends is pivotably connected above the key, wherein the other of the first and second ends is arranged and constructed to abut upon a top surface of the key, said weight lever contacts the top surface of the key upon selection of silent performance mode, wherein said weight lever is capable of inertial motion independently of the key to duplicate hammer throw, said weight lever is removed from contact with the top surface of the key during normal performance mode.

5. The action according to claim 4, wherein said transmission switching device and load switching device operate together.

6. The action according to claim 5, wherein said weight lever has a rotation roller on the other of the first and second ends, and wherein said weight lever abuts upon the top surface of the key via the rotation roller.

7. The action according to claim 6, wherein said top surface of key further includes, layer of sound deadening material, wherein rotation roller abuts upon the top surface of the key via the sound deadening material.

8. The action according to claim 7, wherein sound deadening material is felt.

9. The action according to claim 4, wherein said transmission switching device comprises, a rotation body with a cross section comprising a cam lobe, wherein said cam lobe operating to remove the hammer operating portion away from a physical interface with the key.

10. The action according to claim 4, wherein said load switching device comprises, a lifting rail arranged and constructed to remove the weight levers away from contacting the top surface of the key during the normal performance mode.

11. An action of a piano capable of being switched between a normal performance mode and a silent performance mode, the action comprising:

a hammer operating portion for swinging a hammer to strike a string upon key depression; and a transmission switching device for switching hammer operating portion between normal performance mode and silent performance mode, wherein the hammer operating portion being operated to strike the string in the normal performance mode upon key depression, and the hammer operating portion not being operated in the silent performance mode upon key depression, and a load switching device for providing weighted load for keys, comprising a weight lever comprising a first end and a second end; wherein one of the first and second ends is pivotably connected above the key, wherein the other of the first and second ends is arranged and constructed to abut upon a top surface of the key, said weight lever contacts the top surface of the key upon selection of silent performance mode, wherein said weight lever is capable of inertial motion independently of the key to duplicate hammer throw, said weight lever is moved along the top surface of the key to reduce the effects of the weight lever during normal performance mode.

12. The action according to claim 11, wherein said transmission switching device comprises, a rotation body with a cross section comprising a cam lobe, wherein said cam lobe operating to remove the hammer operating portion away from a physical interface with the key.

13. The action according to claim 11, wherein said load switching device comprises, a slide rail to reposition the other of the first and second ends over the intermediate plate providing the fulcrum of the key during normal performance mode, and wherein the slide rail incrementally positions the other of the first and second ends away from the intermediate plate for adjusting the touch and feel of the key during silent performance mode.

14. The action according to claim 11 wherein the transmission switching device and the load switching device function together.

15. An action of a piano capable of being switched between a normal performance mode and a silent performance mode, the action comprising:

a hammer operating portion for swinging a hammer to strike a string upon key depression; and a transmission switching device for switching hammer operating portion between normal performance mode and silent performance mode, comprising a rotation body with a cross section comprising a cam lobe, wherein said cam lobe operating to remove the hammer operating portion away from a physical interface with the key, and the hammer operating portion being operated to strike the string in the normal performance mode upon key depression, and the hammer operating portion not being operated in the silent performance mode upon key depression, and a load switching device for providing weighted load for keys, comprising a weight lever comprising a first end and a second end;

wherein one of the first and second ends is pivotably connected above the key, wherein the other of the first and second ends is arranged and constructed to abut upon a top surface of the key, a slide rail to reposition the other of the first and second ends over the intermediate plate providing the fulcrum of the key during normal performance mode, and said weight lever contacts the top surface of the key upon selection of silent performance mode, wherein said weight lever is capable of inertial motion independently of the key to duplicate hammer throw, said weight lever is moved along the top surface of the key to reduce the effects of the weight lever during normal performance mode wherein the slide rail incrementally positions the other of the first and second ends away from the intermediate plate for adjusting the touch and feel of the key during silent performance mode.

* * * * *